US010316484B2

(12) United States Patent
Gunter

(10) Patent No.: US 10,316,484 B2
(45) Date of Patent: Jun. 11, 2019

(54) PILE DRIVING GUIDE

(71) Applicant: IHC SEA STEEL LTD., Dorset Blandford Forum (GB)

(72) Inventor: David Howel Gunter, Poole (GB)

(73) Assignee: IHC IQIP UK LTD., Dorset Blandford Forum (GB)

( * ) Notice: Subject to any disclaimer, the term of this patent is extended or adjusted under 35 U.S.C. 154(b) by 0 days.

(21) Appl. No.: 14/434,676

(22) PCT Filed: Oct. 10, 2013

(86) PCT No.: PCT/EP2013/071160
§ 371 (c)(1),
(2) Date: Apr. 9, 2015

(87) PCT Pub. No.: WO2014/057034
PCT Pub. Date: Apr. 17, 2014

(65) Prior Publication Data

US 2015/0284927 A1 Oct. 8, 2015

(30) Foreign Application Priority Data

Oct. 11, 2012 (NL) ..... 2009610

(51) Int. Cl.
*E02D 13/04* (2006.01)
*E02D 9/04* (2006.01)
*E02D 7/02* (2006.01)

(52) U.S. Cl.
CPC ..... *E02D 13/04* (2013.01); *E02D 7/02* (2013.01); *E02D 9/04* (2013.01); *Y10T 29/49817* (2015.01)

(58) Field of Classification Search
USPC ..... 405/227, 228, 229, 231, 232
See application file for complete search history.

(56) References Cited

U.S. PATENT DOCUMENTS 6,354,767 B1 3/2002 Jones
2005/0117976 A1 6/2005 Jones
(Continued)

FOREIGN PATENT DOCUMENTS

CN 1268202 A 9/2000
WO 99/11872 A1 3/1999
(Continued)

OTHER PUBLICATIONS

International Search Report and Written Opinion for corresponding foreign application PCT/EP2013/071160 filed Oct. 10, 2013.
(Continued)

*Primary Examiner* — Sean D Andrish
(74) *Attorney, Agent, or Firm* — Steven M. Koehler; Westman, Champlin & Koehler, P.A.

(57) ABSTRACT

A pile guide is provided comprising a base frame and a pile guide member for guiding the pile as it is driven into a substrate when the base frame is resting thereon. The pile guide member comprises plural guide parts each moveable between a operative position and an inoperative position, each guide part being pivotally mounted on the base frame. At least one guide part is operably coupled or couplable with an associated counterweight for opening of the guide member to its inoperative position under gravity, such that, at least in an inoperative position, at least part of the counterweight and the associated guide part are movable with respect to each other. In another aspect, at least one of the guide parts and/or at least one of the counterweights is detachably connected with the base frame and/or with each other. Methods are also provided.

24 Claims, 6 Drawing Sheets

(56) References Cited

U.S. PATENT DOCUMENTS

| | | | | |
|---|---|---|---|---|
| 2008/0025799 | A1* | 1/2008 | Kawasaki | E02B 17/021 405/198 |
| 2009/0166092 | A1 | 7/2009 | Jones | |
| 2011/0211917 | A1 | 9/2011 | Jones | |
| 2012/0177447 | A1 | 7/2012 | Fraenkel | |
| 2012/0301226 | A1* | 11/2012 | Mack | E02D 31/002 405/228 |

FOREIGN PATENT DOCUMENTS

| | | | |
|---|---|---|---|
| WO | 9911872 | | 3/1999 |
| WO | 0192645 | | 12/2001 |
| WO | 03074795 | | 9/2003 |
| WO | 2007066078 | | 6/2007 |
| WO | 2011083324 | A1 | 7/2011 |

OTHER PUBLICATIONS

Chinese Office Action dated Feb. 15, 2016 for corresponding Chinese Patent Application No. 201380053548.6.
Japanese Office Action with English translation dated Jun. 26, 2017 for Japanese Patent Application No. 2015-536125.

* cited by examiner

PILE DRIVING GUIDE

CROSS-REFERENCE TO RELATED APPLICATION

The present application is a national stage filing of International patent application Serial No. PCT/EP2013/071160, filed Oct. 10, 2013, and published as WO 2014/057034 A1 in English.

TECHNICAL FIELD

The invention relates to pile driving, and more particularly, but not exclusively, to underwater pile driving, e.g. for stabbing piles directly into the seabed.

BACKGROUND ART

The discussion below is merely provided for general background information and is not intended to be used as an aid in determining the scope of the claimed subject matter.

It is known to provide pile guides for underwater piling, see for example, Sea Steel Ltd's range of pile guides as described in WO 99/11872 (Fast Frame pile guide), WO 01/92645 (Finned Frame/Follower pile guide) and WO 03/074795 (Orientation Control pile guide). With such pile guides, piles may be driven into the seabed using hydraulic hammers, such as the IHC Hydrohammers supplied by Dutch Company IHC Hydrohammer BV.

The Fast Frame Pile Guide described in WO 99/11872 comprises a base frame and a pile guide member for guiding a pile as it is driven into a substrate when the base frame is resting thereon. The pile guide member comprises two parts, each of which is pivotally mounted on the base frame. In this way, each of the two parts is moveable relative to the base frame between an operative position and an inoperative position by rotation about a respective pivot axis. The two parts are held in the operative positions by a latch mechanism, and counterweights are provided to urge the parts into their inoperative positions when the latch mechanism is released. With such a pile guide, it is possible to drive piles fully into a substrate without having to interrupt piling to move the pile guide away from the pile once it has been introduced into the substrate, simply by releasing the latch mechanism and allowing the parts of the pile guide to rotate in their inoperative positions to prevent the pile guide fouling the hammer.

The two parts of pile guide member of the Fast Frame Pile Guide define a hollow, substantially cylindrical portion for guiding a pile therethrough, when in the operative position. The substantially cylindrical portion has a plurality of rib-like spacers welded to its inner peripheral surface. Each rib-like spacer is elongate and aligned parallel to a central, longitudinal axis of the substantially cylindrical portion. The thickness of each rib-like spacer in a radial direction is adjusted (e.g. by grinding) to provide a snug, sliding fit with a pile driven through the pile guide member. In this way the spacers are used to take up any dimensional tolerance or slack between the outer diameter of the pile and the inner diameter of the hollow cylindrical portion, albeit at additional cost. Not only does it take time to adjust each spacer, but also repeated welding and removal of spacers risks damage (e.g. heat fatigue) to the pile guide member. The same problem applies to spacers for pile guide members of other pile guides which define a substantially hollow cylindrical portion for guiding a pile therethrough, see for example the pile guides described in WO 03/074795 and WO 2007/066078, the entire contents of which are incorporated herein by reference.

The Fast Frame pile guide is extremely successful, but nevertheless the present applicant is striving to improve the original design, e.g. by reducing weight and providing a structure which is more suitable for containerization with a view to making it easier to transport/store the pile guide.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

In accordance with a first aspect of the present invention, there is provided a pile guide, for supporting a pile as it is driven into a substrate, comprising a base frame and a pile guide member for guiding the pile as it is driven into a substrate when the base frame is resting thereon. The pile guide member comprises plural guide parts each moveable between an operative position and an inoperative position, each guide part being pivotally mounted on the base frame, for rotation about a pivot axis. At least one guide part is operably coupled or couplable with an associated counterweight for opening of the guide member to its inoperative position under gravity, such that, at least in an inoperative position, at least part of the counterweight and the associated guide part are movable with respect to each other.

Thus at least part of the counterweight can be moved with respect to the guide part, preferably the entire counterweight, so that the assembly of the guide part and counterweight as a whole can be deformed in a desired manner. This facilitates operation, maintenance and/or storage of the pile guide. The counterweight and guide part may have a range of motion wherein they are freely movable with respect to each other, without being powered and/or actuated, simplifying the pile guide and facilitating return of the guide member to the operative position for subsequent use. Further, by adjustment of the relative positions of the guide part and the associated counterweight, restriction of the range of motion of the guide part may be reduced or prevented. In particular, the counterweight may be arranged such that it is predictably deformed or "pushed out of the way" by movement of the associated guide part between the operative and inoperative positions. Two opposing guide parts with each one associated counterweight may generally suffice for operation of the pile guide.

In an embodiment, at least part of the counterweight is pivotally connected with the associated guide part. This facilitates cooperation of the counterweight with the pivoting of the associated guide part, in particular when the counterweight is pivotal about a pivot axis that is substantially parallel to the pivot axis of the guide part.

At least one guide part and at least part of the associated counterweight may be pivotal with respect to the base frame about a common pivot axis. This may facilitate design, construction and/or use of the pile guide, reducing damage.

In a particularly efficient embodiment, the pile guide is configured such that in the operative position, the center of gravity of at least one guide part is arranged on a first lateral side of the pivot axis and the center of gravity of the associated counterweight is arrangeable or arranged on a second lateral side opposite the first lateral side for opening of the guide member to a first inoperative position under gravity, and wherein, in the first inoperative position, the center of gravity of the at least one guide part is arranged on the second lateral side for further opening of the guide member to a second inoperative position under gravity.

Due to the counterweight, the effective combined center of gravity of the assembly of the guide part and its associated counterweight is positioned, or at least positionable, on the opposite side of the pivot axis with respect to the guide part's own center of gravity. Thus, the assembly of guide part plus counterweight can pivot under gravity about the pivot axis, which is offset from the center of gravity of the guide part. Therewith, in a first phase of opening the guide member from the operative position to the first inoperative position, assisted by the counterweight the center of gravity of the guide part is brought laterally across the pivot axis, after which, in an optional second phase of further opening the guide member from the first inoperative position to a second inoperative position, further opening can be effected under gravity acting on the center of gravity of the guide part alone, without requiring the counterweight.

In an aspect, a pile guide of the aforementioned type and/or embodiments is provided, comprising a base frame and a pile guide member for guiding the pile as it is driven into a substrate when the base frame is resting thereon, the pile guide member comprising plural parts each moveable between a operative position and an inoperative position, each part being pivotally mounted on the base frame, at least one guide part being operably coupled or couplable with an associated counterweight for opening of the guide member to its inoperative position under gravity. At least one of the guide parts and/or at least one of the counterweights is detachably connected with the base frame and/or with each other, e.g. bolted and/or locked.

Such modular pile guide facilitates transport of the pile guide and allows exchange of the respective guide parts and/or counterweights.

If in an embodiment the counterweight comprises a weighted arm with an adjustable length, storing and transport of the pile guide is facilitated.

If in an embodiment the counterweight comprises a weighted arm of which at least part is supported from the associated guide part by a deformable member, the deformable member may be designed for tensile strength only. E.g. a foldable, flexible and/or collapsible part or frame comprising one or more chains, cables, etc. may be used, although collapsible struts and/or hydraulic cylinders etc. may also be provided. Chains and cables are simple and reliable devices which may have relatively low weight and volume. Chains may facilitate length adjustment by attaching different shackles to the counterweight and/or guide part. Collapsible struts and in particular hydraulic cylinders may provide enhanced control, e.g. for remote operation and/or for use as a brake.

In these latter embodiments, length adjustment of the counterweight arm and/or adjustment of the deformable support member, such as by varying an attachment position to the guide part and/or to the counterweight, enables adjustment of the effective moment and/or lever arm that can be provided by (the center of gravity of) the counterweight for moving the associated guide part from the operative to the inoperative position. This can be used to account for different guide parts in a modular pile guide. It also facilitates operation of a pile guide on inclined substrate surfaces and/or for driving a pile in an oblique, off-vertical direction, in which cases the center of gravity of a guide part is laterally shifted with respect to its pivot axis with the base frame, compared to an ideal case of a horizontal substrate surface and vertically oriented guide.

In an embodiment the center of gravity of at least one guide part may be arranged, in the operative position, on a first lateral side of the pivot axis, and its associated counterweight may be operably decoupled from the at least one guide part for urging the guide member toward the operative position under gravity. This reduces forces on a latching mechanism for maintaining the guide member in its operative position, or allows obviating such latch system altogether. E.g in the operative position, a counterweight may be lifted with respect to the associated guide part to operably decouple them, e.g. deforming a support member such as slackening a support chain, whereupon for opening the guide member the counterweight(s) are made to engage the associated guide part(s), e.g. dropping the counterweight under gravity such that it will become supported by the support chain from the guide part and will exert a pulling force on the guide part to pivot the latter about the pivot axis.

The counterweight may comprise a weighted arm arranged such that, in the operative position of the associated guide part, the weighted arm extends at an angle of approximately 20-60 degrees to the horizontal about the pivot axis of the guide part, e.g. in a range of approximately 30-45 degrees. With a relatively small angle to the horizontal, the effective lever arm of the counterweight is relatively high and a relatively light counterweight and/or a relatively short counterweight arm suffices for pivoting the guide part from its operative position. A small pivoting angle of the guide part and counterweight during opening of the guide member may suffice to shift the guide part's center of gravity from a first lateral side of the guide part's pivot axis with the base frame to a second opposite lateral side. Thereafter the guide part may further move to the second lateral side under gravity by its own weight, and (travel of) the counterweight is not further required. E.g. during such further movement, the counterweight may rest on the base frame while the guide part pivots with respect to both the base frame and the counterweight.

In an embodiment, at least one guide part is pivotal with respect to the base frame over a pivoting angle from the operative position to the inoperative position or further over 45 degrees, preferably over about 60 degrees, more preferably up to about 90 degrees. Plural such guide parts opposite each other forming one guide member can then open the guide member to an opening angle of about 90, 120 or even about 180 degrees. Thus, larger pile driving hammers and pile ancillaries may pass through and/or better access is provided to the interior of the guide part and the parts of the guide member as a whole, e.g. for maintenance and/or repair.

A guide part with a pivoting angle of about 90 degrees may be rested on the base frame, e.g. extending substantially parallel to the base frame, possibly with (part of) the counterweight in between. This facilitates transport and storage, e.g. by reducing height of the overall center of gravity and thus increasing stability.

In a pile guide, in particular in a pile guide as otherwise described and/or claimed herein, the guide member may comprise spacer members for slidably engaging a pile and/or corresponding profile members of a pile to be guided by the pile guide as the pile is driven into a substrate, wherein one or more spacer members are detachably and/or adjustably mounted to at least one guide part. As referred to above, spacers have traditionally been welded to the guide member and they could only be replaced or repaired only by cutting them off. It has now been found that welding is not needed and bolting or otherwise removably fixing such spacers suffices. Moreover, if the pile guide part is pivotal to a large angle, e.g. 60 or 90 degrees from the operative position towards the base frame, access to the associated spacer member(s) is facilitated and rapid adjustment is enabled.

In an embodiment, the position and/or orientation of the pivot axis of at least one guide part and/or a counterweight is adjustable with respect to the base frame. E.g., the pile guide may comprise one or more adjustable hinges. This facilitates orienting one or more pivoting axes in a desired direction. More importantly, this facilitates adjustment of the pile guiding direction with respect to an inclined substrate surface and/or for driving a pile in an oblique, off-vertical direction.

The pile guide may further comprise a mechanism for restoring parts of the guide member and/or counterweights to their operative position from an inoperative position. The mechanism may be configured to drive movement of the pile guide members and/or counterweight from an inoperative position to the operative position only, i.e. the mechanism may be disengaged once the respective parts are locked (e.g. with a latch) in their operative position so that the mechanism does not impede subsequent movement into an inoperative position when released.

In an aspect, a pile guide of the aforementioned type and/or embodiments is provided, comprising a base frame and a pile guide member for guiding the pile as it is driven into a substrate when the base frame is resting thereon, the pile guide member comprising plural parts each moveable between a operative position and an inoperative position, each part being pivotally mounted on the base frame, at least one guide part being operably coupled or couplable with an associated counterweight for opening of the guide member to its inoperative position under gravity. In the pile guide, at least one of the guide parts and/or counterweights is coupled with an actuator for adjusting the position of the guide part and/or counterweight with respect to the base frame. The actuator is pivotally mounted to an intermediate arm that is adjustably mounted to the guide part and/or counterweight.

The actuator may comprise, for example, a hydraulic cylinder. Due to the adjustable mounting, the point of engagement of the actuator to the guide part and/or counterweight can be varied to account for limitations in path, travel and/or force of the actuator.

In the latter pile guide, the intermediate arm may be length adjustable, but preferably it is rigid for simplicity and robustness, and/or the intermediate arm may be mounted to the guide part and/or counterweight at an adjustable angle. In particular, the intermediate arm may extend in orientations in a range between substantially radial to substantially tangential with respect to the pivoting axis of the guide part and/or counterweighted arm to the base frame.

In an aspect, a method is provided, comprising providing a modular pile guide as claimed herein, and exchanging a guide part and/or a counterweight.

In another aspect, a method for driving a pile into a substrate is provided, in particular driving a pile into a substrate under water, comprising the steps of: providing a pile guide as described herein, wherein at least one guide part of the pile guide has a center of gravity arranged, in the operative position, on a first lateral side of the pivot axis; and opening the guide member to an inoperative position under gravity, wherein by the opening the center of gravity of the at least one guide part is transferred to a second lateral side of the pivot axis opposite the first lateral side. Preferably, the method further comprises the step of further opening of the guide member to a further inoperative position under gravity while moving at least part of the guide part with respect to the associated counterweight.

BRIEF DESCRIPTION OF THE DRAWINGS

The above-described aspects will hereafter be more explained with further details and benefits with reference to the drawings showing an embodiment of the invention by way of example.

DETAILED DESCRIPTION OF EMBODIMENTS

Figure 1:
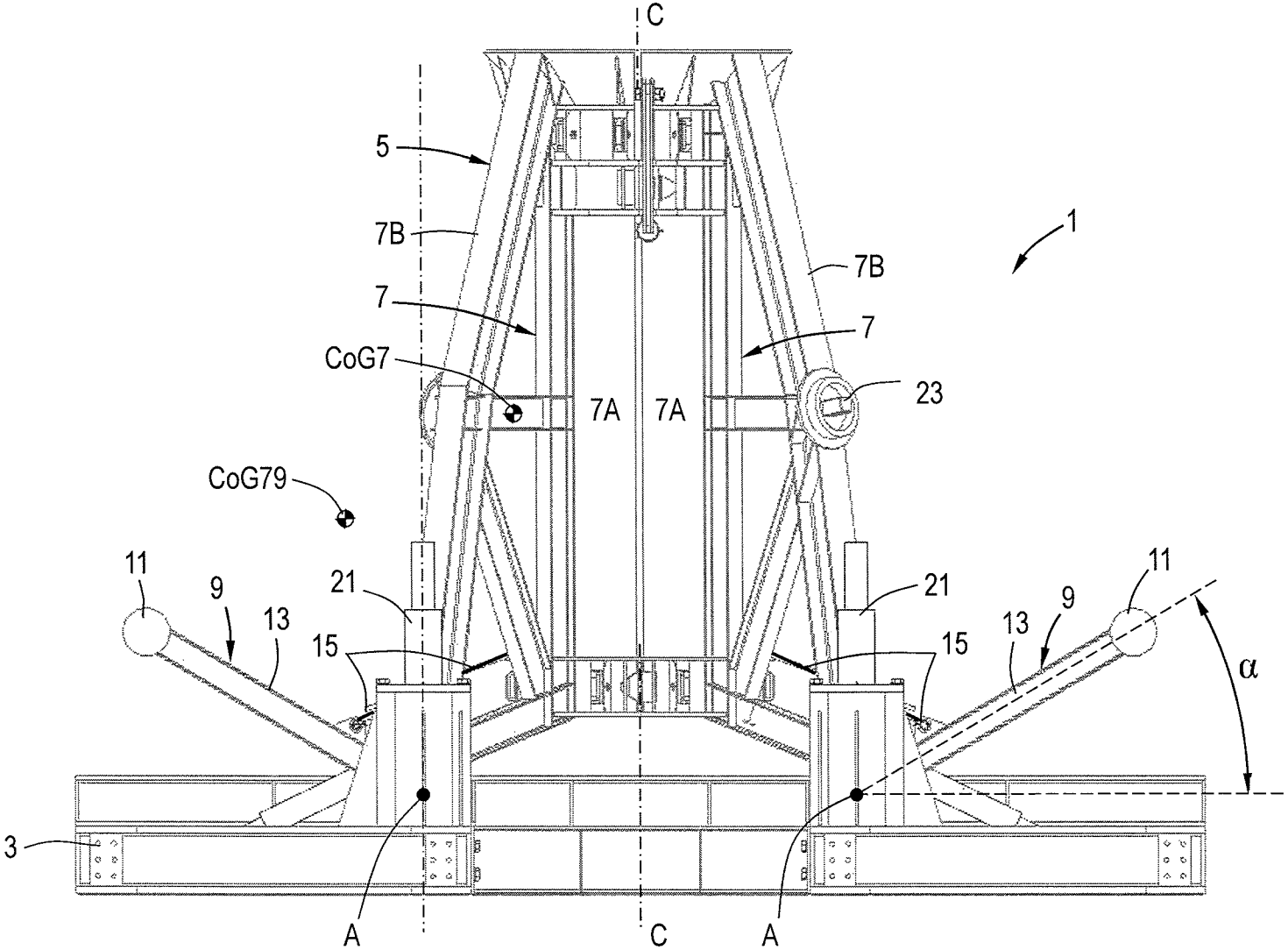
FIG. 1 is a side view of an improved pile guide in operative position.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral.

Figure 2:
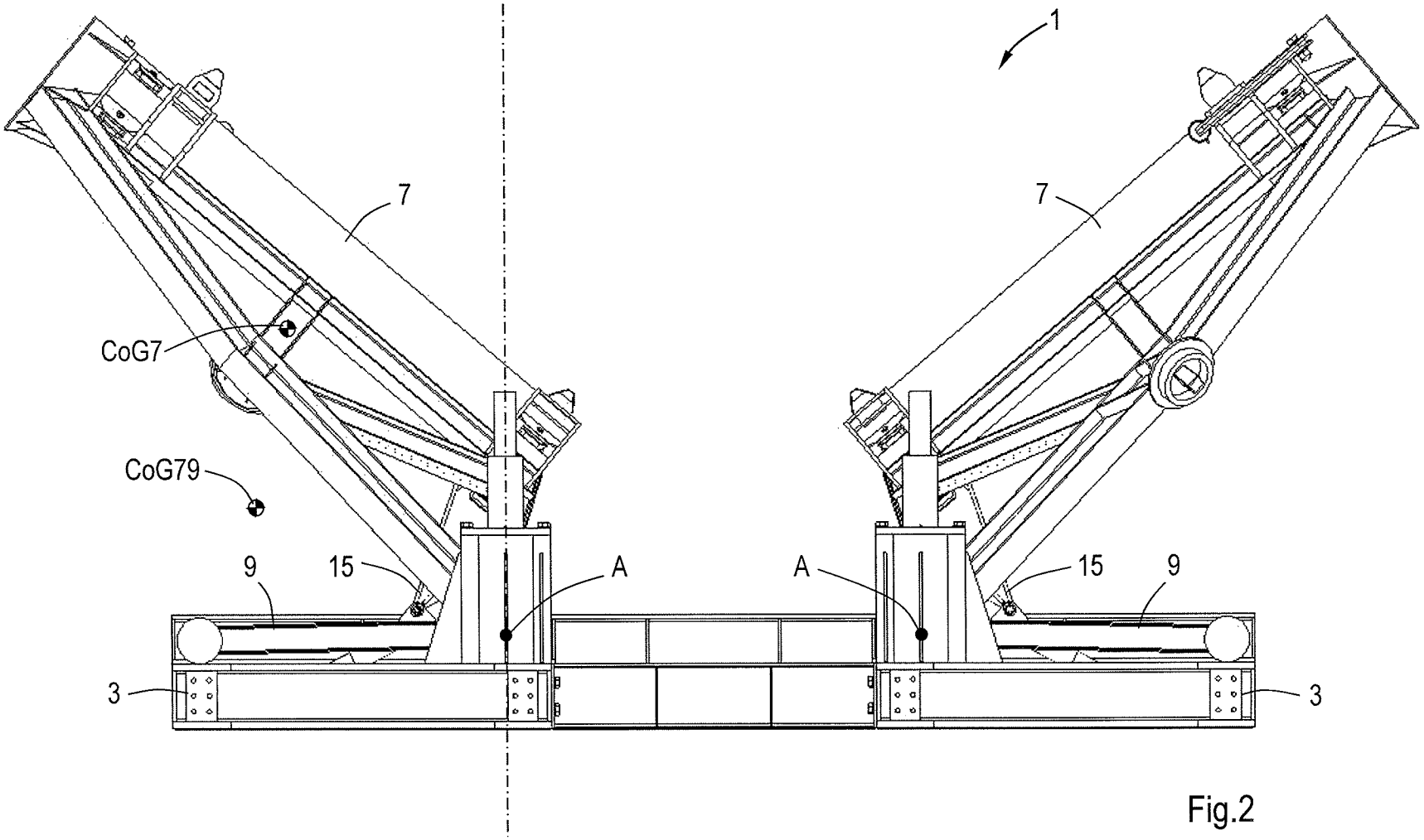
FIG. 2 is a side view of the pile guide of FIG. 1 in a first inoperative position.
Figure 3:
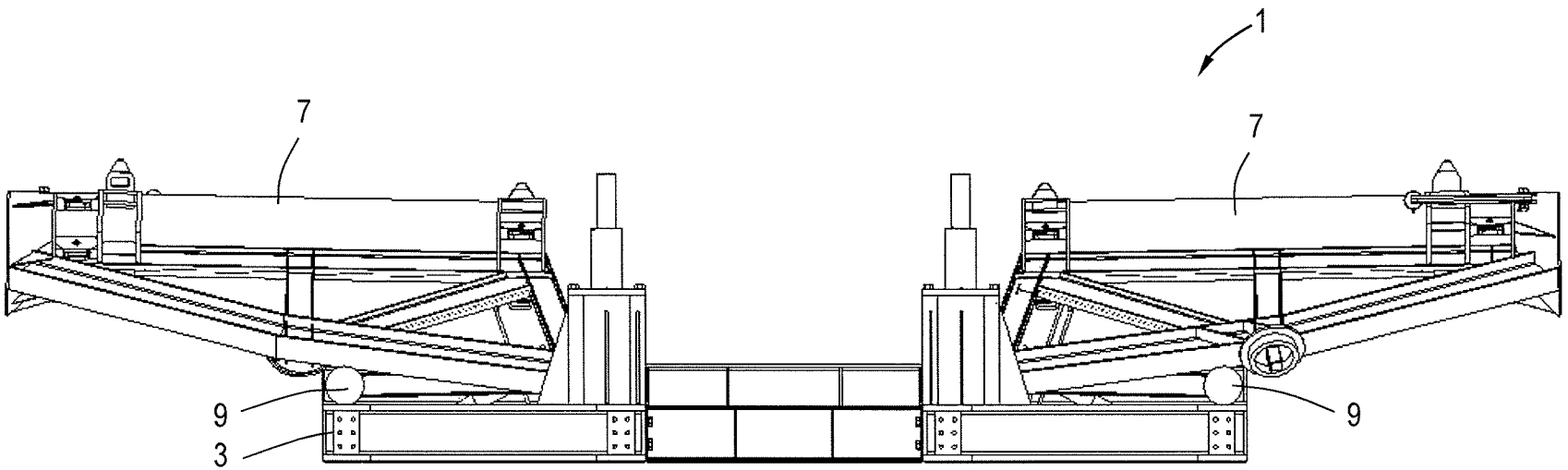
FIG. 3 is a side view of the pile guide of FIG. 1 in second inoperative position, being fully opened.
Figure 4:
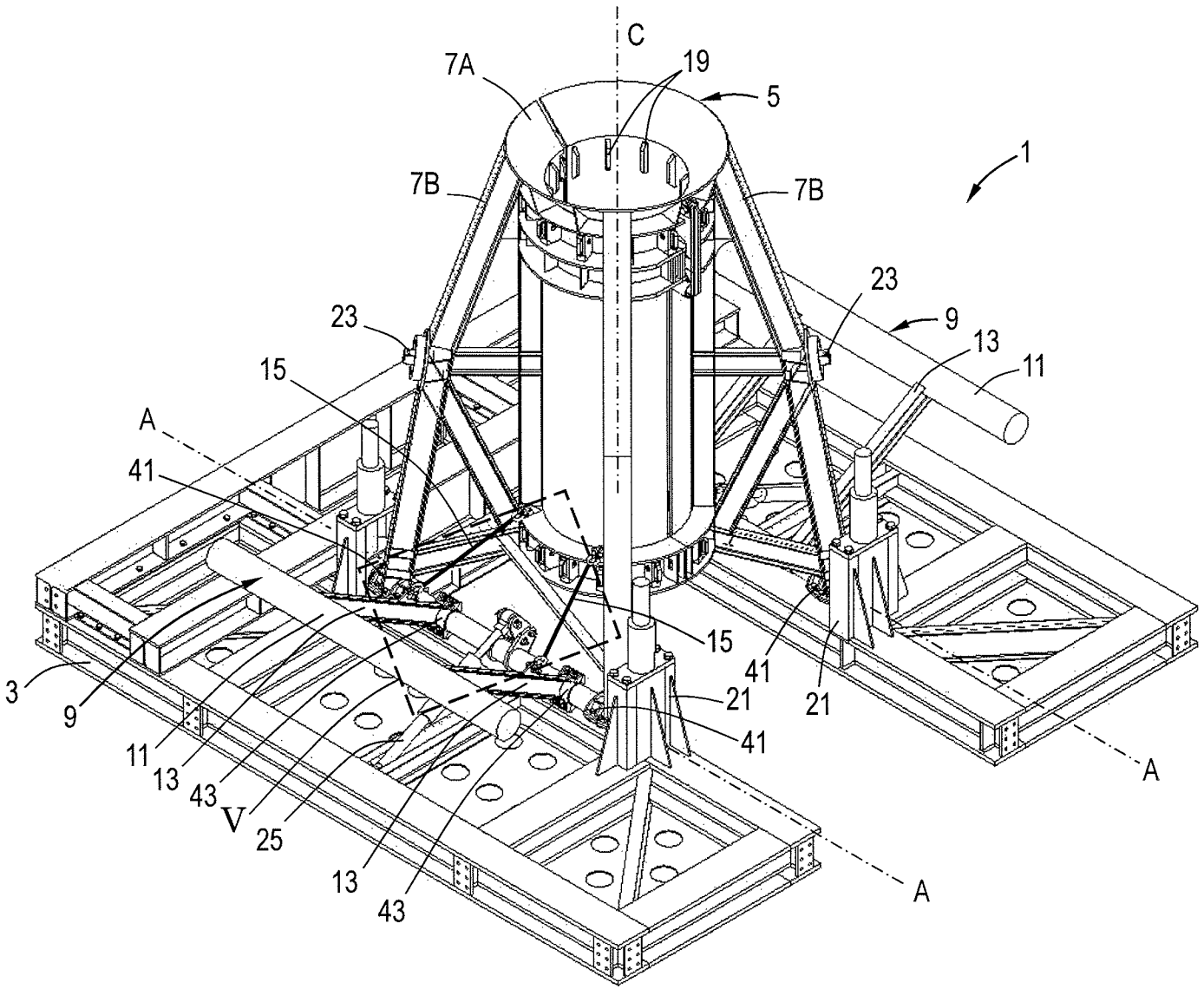
FIG. 4 is an isometric view of the pile guide of FIG. 1 in operative position.

FIGS. 1-4 show a pile guide 1, for supporting a pile as it is driven into a substrate. The pile guide 1 comprises a base frame 3 and a pile guide member 5 for guiding the pile (not shown) as it is driven into a substrate (not shown) when the base frame is resting thereon. The pile guide member 5 extends along a central axis C and comprises two guide parts 7, comprising a generally concave main body portion 7A and a support frame 7B, each guide part 7 being pivotally mounted on the base frame 3 for rotation about a respective pivot axis A and movable between a operative position (FIG. 1) and an inoperative position (FIG. 2), see below. The pivot axes A extend generally parallel to each other and perpendicular to the central axis C (FIG. 4). Typically, the pile guide 1 is used for driving piles under water in a seabed, river bed or the like, and the base frame 3 may also be referred to as a "mud mat".

Figure 5:
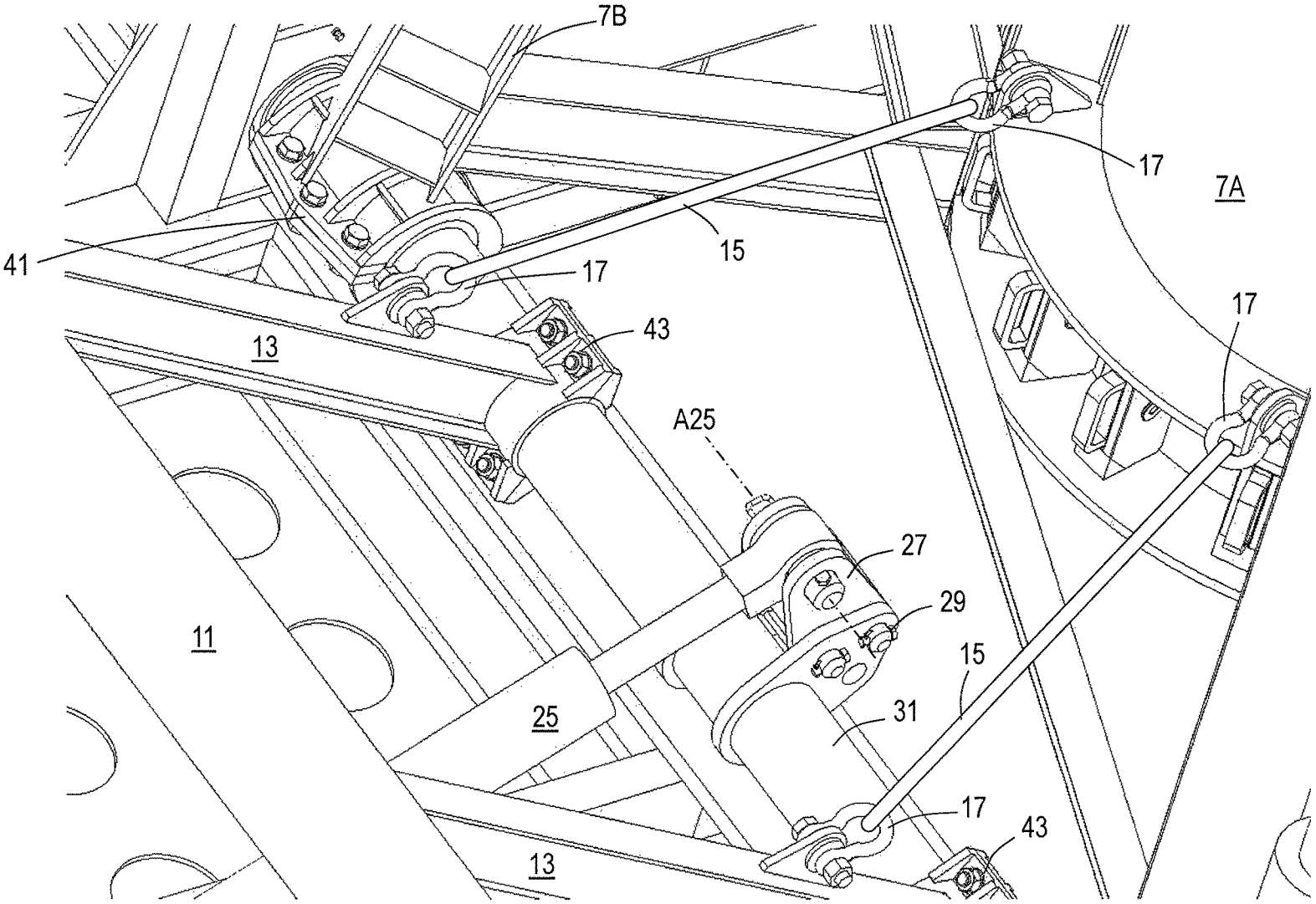
FIG. 5 shows detail V of FIG. 4.

Best seen in FIGS. 1 and 4, each guide part 7 is coupled with an associated counterweight 9. Here, each counterweight 9 comprises a weight 11 supported on rigid arms 13 that are pivotally mounted on the base frame 3 for rotation about the respective pivot axis A and, at least in the operative position of the guide member 5 (FIG. 1), supported from the associated guide part 7 by a pair of chains 15 (schematically indicated). Here, the chains 15 are support members and are detachably mounted to the counterweight and the guide part with openable D-shackles 17 (FIG. 5). However, different attachments and/or support members may be provided and the arms 13 of the counterweight may be configured to be extendible. Also, the counterweight may be formed differently and have several parts that are movable with respect to each other. On the interior side of the guide parts 7 optional removable spacer members 19 are provided for guiding and possibly rotating accordingly shaped piles, e.g. according to WO 03/074795 referred to above (FIG. 4—pile not shown).

Each guide part 7, herein arm 13, of its associated counterweight 9 is pivotable not only with respect to the base frame 3 but also with respect to each other, here being independently pivotable about the respective common pivot axis A, although each may be pivotal about different axes. As apparent from FIGS. 1 and 4, by adjusting the effective length of the chains 15, the angle of extension .alpha. of the counterweight's arms 13 relative to the base frame 3 in the operational position of the guide member 5, may be suitably adjusted, e.g. for adjusting the center of gravity and/or the travel of the counterweight 9.

FIGS. 1-3 indicate possible use of the pile guide 1, showing different positions of the guide member parts 7 relative to the base frame 3. In the operative position (FIG. 1) the guide parts 7, herein the main body portions 7A, together define a hollow cylinder for guiding a pile therethrough along a longitudinal axis extending substantially vertically. The guide parts 7 are held in the operative position by a suitable locking mechanism such as a latch (not indicated). The guide parts 7, and thus their respective centers of gravity CoG7, are arranged generally on a laterally inward side of the respective pivot axes A with respect to the guide member 5 (see the vertical dashed line through the pivot axis A in FIG. 1). However, each counterweight 9 is configured such that the collective center of gravity CoG79 of the assembly of a guide part 7 and the associated counterweight 9 is arranged on an outside of the pivoting axis A with respect to the pile guide member 5 (FIG. 1). Thus, once the locking mechanism is released, each part 7 will rotate outward under gravity to a first inoperative position, opening the guide member 5, and by which the counterweight 9 may come to rest on the base frame 3 (FIG. 2). It is noted that the pivot axis A is eccentric with respect to the guide part 7, so that the guide parts 7 as a whole can be pivoted away from the pile (not shown). In FIG. 2 of the shown embodiment the closest separation of the opposite guide parts 7 is even about equal to the separation of the pivot axes A. Importantly, by such rotation the center of gravity CoG7 of the guide part 7 itself is shifted from the laterally inward side of the pivot axis A to the opposite, laterally outward side. This provides a moment driving further rotation under gravity of the guide part 7 by its own weight about the pivot axis A, further opening the guide member 5. Finally, another inoperative position shown in FIG. 3 may be achieved wherein the guide parts 7 are arranged substantially horizontally on the base frame 3, having pivoted with respect to the counterweights 9 as facilitated by relative rotational movement of the guide parts 7 with respect to their associated counterweights 9 and by deformation (slackening) of the support chains 15. In such position the pile guide 1 may be easily transported, stored and/or serviced. E.g., best seen by comparing FIGS. 3 and 4, spacer members 19 and the support members 15 thus become readily accessible for maintenance and/or exchange.

Summarising, operation and use of the pile guide may comprise the following steps:

a) arranging the pile guide 1 on a substrate, e.g. underwater, on the seabed;
b) arranging the guide member 5 in the operative position, preferably before step a, but possibly during and/or after step a, and preferably including latching the guide parts 7 in the operative position;
c) arranging the pile to be driven in the pile guide 1 such that it is at least partially supported by the pile guide member 5;
d) driving the pile into the substrate to a point of self-stability in the substrate;
e) opening the guide member 5 to an inoperative position, comprising:
f) unlocking optional latches, e.g. for keeping guide parts 7 in the operative position;
g) allowing the counterweights 9 to pull back the guide parts 7 against the action of gravity on them and far enough to counteract the guide part's 7 center of gravity CoG7, e.g. about 30 degrees away from vertical/60 degrees to horizontal;
h) allowing the guide parts 7 to fall further open under gravity while deforming at least part of the counterweight 9, e.g. while the counterweight 9 lays redundant on the base frame/mud mat 3, e.g. further opening the guide parts 7 to approximately 45 degrees with respect to vertical and horizontal; and
i) allowing pile driving apparel e.g. a pile padeye and/or a driving hammer to pass through the opened guide member 5 to final penetration of the pile.

The guide members may be opened still further than about 45-60 degrees from vertical/45-30 degrees from horizontal, but generally they are only opened fully for transport, disassembly, and/or spacer adjustment, in particular whilst onshore. For subsequent use, e.g. with another pile, the guide parts are pivoted back into the operative position and the counterweights are also restored accordingly, e.g. in an operation simply reversing the opening action.

For adjusting relative orientations of the base frame 3 and the guide member 5, e.g. in case of use on an inclined substrate surface, adjustable pivot mounts 21 are provided. With these mounts 21, hinge or pivot portions may be raised or lowered relative to the base frame 3, and one or both sides of one or both pivot axes A may be adjusted to reposition and/or tilt the respective pivot axis A relative to the base frame 3 in known manner, and thereby to adjust the central axis C of the guide member 5.

The guide member parts 7 and/or the counterweights 9 may be brought and/or restored into their operative position from an inoperative position by a suitable hoisting and/or lifting arrangement (e.g. by connecting a fork lift and/or a crane to optional mountings 23). In the shown pile guide, the guide parts 7 and the counterweights 9 may be independently restored, by disconnecting the guide part 7 and associated counterweights 9 (e.g. detaching an end of the chains 15), restoring and locking the guide parts 7 to the operative position and subsequently lifting the counterweights 9 and reconnecting them to the respective associated guide parts 7 with the support. Thus, "lighter" tools may be used than when an integral assembly of a guide part 7 plus counterweight 9 must be lifted.

Figure 6:
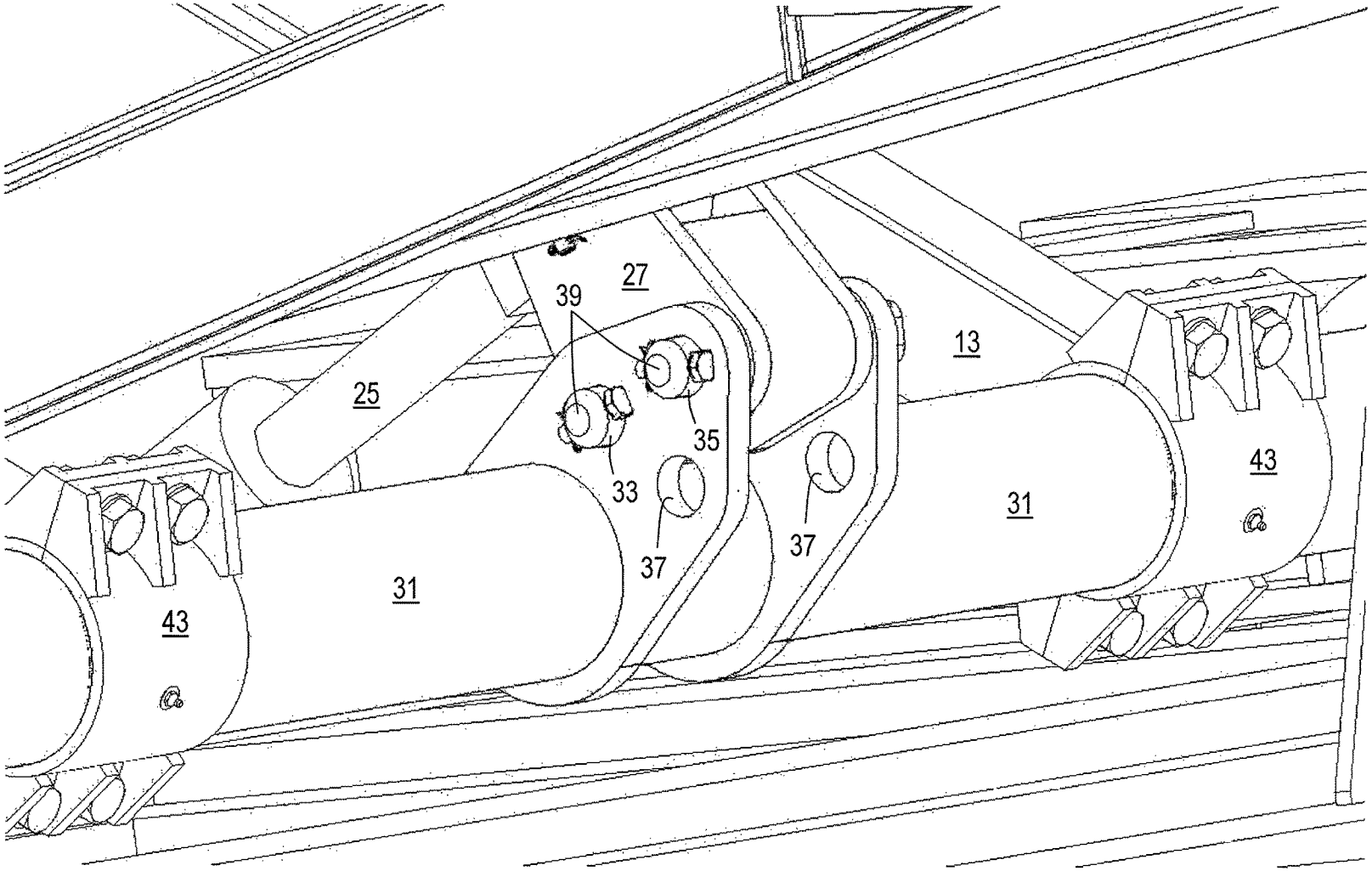
FIG. 6 shows the central portion of detail V of FIG. 4 from another viewing angle.

However, the shown pile guide 1 comprises an optional mechanism for restoring guide member parts 7 and counterweights 9 to their operative position from an inoperative position, see in particular FIGS. 4-6. The mechanism comprises an actuator 25 for adjusting the position of the guide part 7 with respect to the base frame, in the form of a hydraulic cylinder 25. Although the actuator may be directly attached to a main body portion 7A of the guide part 7 that forms part of the cylindrical sleeve, in the shown embodiment the actuator 25 is mounted to an intermediate arm 27 pivotal about a pivot axis A25. The intermediate arm 27, in turn, is attached via a mounting 29 to a hinge portion 31 of the guide part 7, herein the support frame 7B, such that the arm 27 is fixable to the mounting 29 in different configurations. Here, best seen in FIG. 6, the mounting 29 comprises three sets of through holes 33, 35, 37 which may be connected pairwise to corresponding holes in the arm 27 with fasteners 39 (the pair of through holes 33 and 35, as shown in FIGS. 4-6 or, respectively, the pair of through holes 33 and 37). Thus, the positions of engagement of the arm 27 and therewith of the actuator 25 to the the guide part 7, herein the support frame 7B, about the pivot axis A can be varied. Due to the adjustable mounting, the point of engagement of the actuator to the guide part 7 and/or counterweight 9 can be varied to account for limitations in path, travel and/or force of the actuator 25. E.g., this allows to account for the stroke of the actuator 25 during rotation of the guide part 7 between the operative position and the first inoperative position shown in FIG. 2 and the second inoperative position shown in FIG. 3, and/or for raising and/or tilting of the pivot axis A with respect to the base frame 3. Thus, an actuator 25 with relatively short stroke may suffice. It is noted that more and/or different arrangements and/or different attachment techniques may be used for suitably mounting an actuator.

Best seen in FIGS. 4-6, in particular FIG. 5, in the shown embodiment each guide part 7 and counterweight 9 is, as an option, detachably mounted to the pivot assembly and therewith to the base frame and to each other via respective bolted mountings 41, 43. This allows removal and/or exchange of a guide part 7 and/or a counterweight 9, e.g. for storage, transport and/or maintenance. This also facilitates modification of the pile guide 1, e.g. for use with different guide parts to guide piles of a different type or size.

In view of the harsh conditions of pile driving, in particular offshore subsea pile driving, pile guides have traditionally been developed with continuously increased robustness and simplicity, reducing the number of parts and/or providing parts as unitary objects and/or substantially permanently fixed together objects (e.g. welded or riveted) wherever possible. It has now been found that such robustness may, in fact, not be needed and that, by increasing complexity of the pile guide against the traditional trend, by making parts movable and/or detachable with respect to each other, the pile guide's overall weight may be significantly reduced and its operational flexibility vastly increased.

The invention is not restricted to the above described embodiments which can be varied in a number of ways within the scope of the claims. For instance it is possible to configure the pile guide such that in normal operation the guide parts are used between the operative position of FIG. 1 and an inoperative position generally as shown in FIG. 2, and that a more fully open position e.g. generally as shown in FIG. 3 is only used for transport and/or maintenance, e.g. by use of suitable stops and/or by adjustment of the mounting arrangement 27, 29, 31 of the actuator 25.

Further more guide parts may be used, the guide member and/or guide part frame may differ, the base frame may be smaller, larger and/or differently formed. Also, plural pile guides may be combined, possibly detachably, to a multi-pile guide template.

Connections for hoisting arrangements and/or for connecting with an Remotely Operated Vehicle (ROV) e.g. for power requirements may be provided Elements and aspects discussed for or in relation with a particular embodiment may be suitably combined with elements and aspects of other embodiments, unless explicitly stated otherwise.

The invention claimed is:

1. A pile guide comprising:

a base frame and a pile guide member configured to guide a pile as the pile is driven into a substrate when the base frame is resting thereon, the pile guide member comprising plural guide parts each moveable between an operative position and an inoperative position, each guide part being pivotally mounted on the base frame on a guide part pivot axis, wherein one of the plural guide parts is operably coupled to a counterweight, said counterweight being configured to open said one of the plural guide parts to the inoperative position under gravity, wherein, at least in the inoperative position, said one of the plural guide parts and at least part of the counterweight are movable with respect to each other, such that said one of the plural guide parts and the counterweight form a deformable assembly for adjusting the positions of said one of the plural guide parts and the counterweight relative to each other.

2. The pile guide according to claim 1, wherein at least part of the counterweight is pivotally connected with said one of the plural guide parts, being pivotal with respect to said one of the plural guide parts.

3. The pile guide according to claim 1, wherein said one of the plural guide parts and at least part of the counterweight are pivotal with respect to the base frame about a common pivot axis.

4. The pile guide according to claim 1, wherein the pile guide is configured such that in the operative position, a center of gravity of said one of the plural guide parts is arranged on a first lateral side of the guide part pivot axis of said one of the plural guide parts and a center of gravity of the counterweight is arranged on a second lateral side of the guide part pivot axis of said one of the plural guide parts opposite the first lateral side to move said one of the plural guide parts to the inoperative position under gravity, and in the inoperative position, the center of gravity of said one of the plural guide parts is arranged on the second lateral side of the guide part pivot axis for further opening of said one of the plural guide parts to a second inoperative position under gravity.

5. The pile guide according to claim 1, wherein the pile guide member comprises spacer members configured to slidably engage at least one of the pile and corresponding profile members of the pile to be guided by the pile guide as the pile is driven into the substrate, and wherein one or more of the spacer members are mounted at least one of detachably and adjustably to at least one guide part of the plural guide parts.

6. The pile guide according to claim 1, comprising a lock configured to lock the guide parts in the operative position.

7. The pile guide according to claim 1, comprising a mechanism configured to restore said one of the plural guide parts to the operative position from the inoperative position.

8. The pile guide according to claim 1, wherein the counterweight comprises a weighted arm that has an adjustable length.

9. The pile guide according to claim 8, wherein, in the operative position of said one of the plural guide parts, the weighted arm extends at an angle of approximately 20-60 degrees to a horizontal about a pivot axis of said one of the plural guide parts.

10. The pile guide according to claim 1, wherein at least one of a position of the guide part pivot axis, an orientation of the guide part pivot axis of said one of the plural guide parts, a position of the counterweight, and an orientation of the counterweight is adjustable with respect to the base frame.

11. The pile guide according to claim 1 wherein the counterweight comprises a weighted arm, and wherein at least part of the weighted arm is supported from said one of the plural guide parts by a deformable member.

12. The pile guide according to claim 1, wherein said one of the plural guide parts and the counterweight form the deformable assembly for adjusting the positions of said one of the plural guide parts and the counterweight relative to each other during movement of said one of the plural guide parts from the operative position to the inoperative position.

13. A pile guide, comprising:

a base frame, a pile guide member configured to guide a pile as the pile is driven into a substrate when the base frame is resting thereon, the pile guide member comprising plural guide parts each moveable between an operative position and an inoperative position, each guide part being pivotally mounted on the base frame, and a counterweight, wherein at least one guide part of said plural guide parts is operably coupled with the counterweight to move the at least one guide part to the inoperative position under gravity, and at least one of:

the at least one guide part is detachably connected with the base frame, the counterweight is detachably connected with the base frame, and the at least one guide part is detachably connected with the counterweight.

14. The pile guide according to claim 13, wherein the counterweight comprises a weighted arm that has an adjustable length.

15. The pile guide according to claim 14, wherein, in the operative position of the at least one guide part, the weighted arm extends at an angle of approximately 20-60 degrees to a horizontal about a pivot axis of the at least one guide part.

16. The pile guide according to claim 14 wherein at least part of the weighted arm is supported from the at least one guide part by a deformable member.

17. The pile guide according to claim 13, wherein the at least one guide part is pivotal with respect to the base frame over a pivoting angle from the operative position to the inoperative position over 45 degrees.

18. The pile guide according to claim 13, wherein at least one of a position and orientation of a pivot axis of the at least one guide part and counterweight is adjustable with respect to the base frame.

19. The pile guide of claim 13 wherein at least one of the at least one guide part and/or the counterweight is detachably connected with at least one of a pivot assembly connecting the at least one guide part or counterweight to the base frame and with each other.

20. A pile guide comprising:

a base frame and a pile guide member configured to guide a pile as the pile is driven into a substrate when the base frame is resting thereon, the pile guide member comprising plural guide parts each moveable between an operative position and an inoperative position, each guide part being pivotally mounted on the base frame, wherein at least one guide part of the plural guide parts is operably coupled with an associated counterweight to move the at least one guide part to the inoperative position under gravity, wherein at least one of the at least one of the guide parts and/or associated counterweight is coupled with an actuator configured to adjust a position of the at least one guide part or associated counterweight with respect to the base frame, wherein the actuator is pivotally mounted to an intermediate arm that is adjustably mounted to the at least one guide part and/or associated counterweight.

21. The pile guide according to claim 20, wherein the intermediate arm is at least one of length adjustable, mounted to the at least one guide part, and mounted to the counterweight at an adjustable angle.

22. A method of modifying a pile guide, comprising:

providing a pile guide having a base frame and a pile guide member configured to guide a pile as the pile is driven into a substrate when the base frame is resting thereon, the pile guide member comprising plural guide parts each moveable between an operative position and an inoperative position, each guide part being pivotally mounted on the base frame, and a coupling to couple at least one guide part of the plural guide parts with an associated counterweight configured to open the at least one guide part to the inoperative position under gravity, wherein the coupling, at least in the inoperative position, allows at least part of the counterweight and the at least one guide part to move with respect to each other, and using the coupling to exchange one of the at least one guide part and the at least part of the counterweight.

23. A method for driving a pile into a substrate, comprising:

providing a pile guide having a base frame and a pile guide member configured to guide the pile as the pile is driven into the substrate when the base frame is resting thereon, the pile guide member comprising plural guide parts each moveable between an operative position and an inoperative position, each guide part being pivotally mounted on the base frame, wherein at least one guide part of the plural guide parts is operably coupled with an associated counterweight configured to open the at least one guide part to the inoperative position under gravity, such that, at least in the inoperative position, at least part of the counterweight and the at least one guide part are movable with respect to each other, wherein the at least one guide part of the pile guide has a center of gravity arranged, in the operative position, on a first lateral side of a pivot axis of the at least one guide part;

opening the at least one guide part to the inoperative position under gravity, wherein opening moves the center of gravity of the at least one guide part to a second lateral side of the pivot axis opposite the first lateral side; and opening of the pile guide member to a further inoperative position under gravity while moving at least part of the at least one guide part with respect to the associated counterweight.

24. The method of claim 23, wherein driving the pile into the substrate comprises driving the pile into the substrate under water.

* * * * *